US011304442B2

(12) United States Patent
Deng et al.

(10) Patent No.: US 11,304,442 B2
(45) Date of Patent: Apr. 19, 2022

(54) SMOKE GENERATION PRODUCT AND MANUFACTURING METHOD THEREFOR

(71) Applicants: SICHUAN SANLIAN NEW MATERIAL CO., LTD., Sichuan (CN); CHINA TOBACCO SICHUAN INDUSTRIAL CO., LTD., Sichuan (CN)

(72) Inventors: Yong Deng, Sichuan (CN); Xiang Fei, Sichuan (CN); Jiang Wu, Sichuan (CN); Kai Liu, Sichuan (CN); Jin Ma, Sichuan (CN); Yufeng Sun, Sichuan (CN); Kuan Dai, Sichuan (CN); Rengang Zhang, Sichuan (CN); Yi Bao, Sichuan (CN); Bengang Yang, Sichuan (CN); Jin Han, Sichuan (CN); Hongbo Shu, Sichuan (CN); Donglin Han, Sichuan (CN)

(73) Assignees: SICHUAN SANLIAN NEW MATERIAL CO., LTD., Sichuan (CN); CHINA TOBACCO SICHUAN INDUSTRIAL CO., LTD., Sichuan (CN)

( * ) Notice: Subject to any disclaimer, the term of this patent is extended or adjusted under 35 U.S.C. 154(b) by 131 days.

(21) Appl. No.: 16/479,491

(22) PCT Filed: Jul. 9, 2018

(86) PCT No.: PCT/CN2018/095046

§ 371 (c)(1),
(2) Date: Jul. 19, 2019

(87) PCT Pub. No.: WO2019/019909

PCT Pub. Date: Jan. 31, 2019

(65) Prior Publication Data

US 2020/0138096 A1 May 7, 2020

(30) Foreign Application Priority Data

Jul. 28, 2017 (CN) ..... 201710627274.7

(51) Int. Cl.

| | |
|---|---|
| ***A24D 1/04*** | (2006.01) |
| ***A24D 3/02*** | (2006.01) |
| ***A24D 1/00*** | (2020.01) |

(52) U.S. Cl.

CPC ..... *A24D 3/0216* (2013.01); *A24D 1/002* (2013.01); *A24D 1/042* (2013.01); *A24D 1/045* (2013.01)

(58) Field of Classification Search

CPC ..... A24D 1/04; A24D 3/048

See application file for complete search history.

(56) References Cited

U.S. PATENT DOCUMENTS

2010/0275935 A1* 11/2010 Fiebelkorn ..... A24D 1/02 131/58
2011/0083676 A1* 4/2011 Karies ..... A24D 3/025 131/274

(Continued)

FOREIGN PATENT DOCUMENTS

CN 204519372 8/2015
CN 104921296 9/2015

(Continued)

OTHER PUBLICATIONS

First Office Action of priority document CN201710627274.7, 6 pages.

(Continued)

*Primary Examiner* — Eric Yaary
(74) *Attorney, Agent, or Firm* — Bayramoglu Law Offices LLC

(57) ABSTRACT

A smoke generation product and a manufacturing method therefor, which relate to the technical field of tobaccos. The (Continued)

smoke generation product comprises a filter tip base body, a second connecting component, and an aroma generation portion. The filter tip base body comprises a first connecting component, and comprises a cooling portion and a filtering portion that are sequentially disposed in a smoking direction. The filtering portion and the cooling portion are connected by means of the first connecting component. A filtering passage and a cooling passage are in mutual communication. The aroma generation portion is connected to the filter tip base body by means of the second connecting portion, and the aroma generation portion is configured to release smoke by means of heating and make the smoke enter the cooling passage.

19 Claims, 3 Drawing Sheets

(56) References Cited

U.S. PATENT DOCUMENTS

| | | | | |
|---|---|---|---|---|
| 2013/0167851 | A1* | 7/2013 | Ademe | A24C 5/472 131/280 |
| 2015/0296878 | A1* | 10/2015 | Mucalo | A24D 3/048 131/335 |
| 2016/0100632 | A1 | 4/2016 | Debono et al. | |
| 2016/0295909 | A1* | 10/2016 | Besso | A24D 3/14 |
| 2017/0042221 | A1* | 2/2017 | England | A24F 40/20 |

FOREIGN PATENT DOCUMENTS

| | | |
|---|---|---|
| CN | 204707983 | 10/2015 |
| CN | 204969457 | 1/2016 |
| CN | 105852227 | 8/2016 |
| CN | 106954893 | 7/2017 |
| CN | 107259639 | 10/2017 |
| CN | 207118597 | 3/2018 |

OTHER PUBLICATIONS

English translation of First Office Action of priority document CN201710627274.7, 6 pages.
International Search Report and Written Opinion of priority application PCT/CN2018/095046.
English translation of International Search Report of priority application PCT/CN2018/095046, 3 pages.
First Search of Priority document CN2017106272747, 2 pages.

* cited by examiner

SMOKE GENERATION PRODUCT AND MANUFACTURING METHOD THEREFOR

CROSS-REFERENCE TO RELATED APPLICATIONS

This application is a national stage entry under 35 USC § 371 of PCT International Application Number PCT/CN2018/095046, filed Jul. 9, 2018, which claims priority to Chinese Patent Application No. 201710627274.7, filed with the Chinese Patent Office on Jul. 28, 2017, entitled "Smoke generation product and Method of Manufacturing the Same", which is incorporated herein by reference in its entirety. All of the aforementioned applications are hereby incorporated by reference in their entireties.

TECHNICAL FIELD

The present disclosure relates to the technical field of tobacco, and in particular to a smoke generation product and a method of manufacturing the same.

BACKGROUND ART

In recent years, as people are paying continuous attention to the issue of passive smoking, the smoke environment caused by burning tobacco has become one of the focuses of the public's debates about smoking and health issues. Traditional cigarettes are ignited by using an open flame and may have a temperature of 800° C. or higher, at which a large amount of harmful ingredients like polycyclic aromatic hydrocarbons is generated by thermal cracking. The study has found that there is almost no thermal cracking process below 400° C. Therefore, how to reduce the combustion temperature has become a hot research topic in the tobacco industry. However, a reduced combustion temperature is likely to cause flameout, and a low-temperature heat-not-burn smoke generation product comes into being accordingly.

Such smoke generation products are not heated by burning, but are heated by electric heating or other heating means to release substances such as flavor ingredients therefrom, thereby avoiding the generation of a large amount of harmful ingredients due to pyrolysis at high temperature. While the smoker is getting a feeling of satisfaction, the harm to the human body is reduced, and moreover the pollution from the environmental smoke is reduced.

However, the prior smoke generation products have a complicated structure, need to be designed and manufactured with special equipment, and have a high cost; and the prior smoke generation products have a single structure and function, and it is difficult to change the structure of the smoke generation products at a low cost according to design requirements.

SUMMARY

The present disclosure provides a smoke generation product and a method of manufacturing the same to overcome the problems of a complicated structure and a high production cost of the prior smoke generation products, and the smoke generation product of the present disclosure has a variety of functions.

An aspect of the present disclosure includes a smoke generation product, comprising: a filter base body, wherein the filter base body comprises a first connector, and a cooling portion and then a filtration portion which are sequentially disposed along an inhalation direction, there is a filtration passage inside the filtration portion, there is a cooling passage inside the cooling portion, the filtration portion and the cooling portion are connected by the first connector, and the filtration passage and the cooling passage communicate with each other. It further comprises a second connector. It further comprises a flavor-producing portion, the flavor-producing portion is connected to the filter base body via the second connector, and the flavor-producing portion is configured to release smoke into the cooling passage by being heated.

Optionally, an isolation portion is further disposed between the flavor-producing portion and the filter base body, and an isolation passage is disposed inside the isolation portion.

Optionally, the smoke generation product of the present disclosure further comprises a third connector, and the flavor-producing portion and the isolation portion are connected by the third connector. The third connector, the isolation portion, and the flavor-producing portion constitute a cigarette base body, and the cigarette base body and the filter base body are connected by the second connector.

Optionally, the flavor-producing portion includes a flavor-producing material.

Optionally, the flavor-producing material includes one or more of grass leaves, whole tobacco leaves, main veins of tobacco leaves, expanded tobacco, and homogenized tobacco.

Optionally, the first connector includes a plug wrap which is wrapped around outer circumferential surfaces of the filtration portion and the cooling portion.

Optionally, the second connector includes a tipping paper, a part of the tipping paper is wrapped around outer circumferential surfaces of the filtration portion and the cooling portion, and another part of the tipping paper is wrapped around an outer circumferential surface of one end of the flavor-producing portion close to the cooling portion.

Optionally, there are a plurality of cooling passages inside the cooling portion, and the plurality of cooling passages jointly communicate with the filtration passage.

Optionally, a flavor-emanating component includes a bead in which a flavor liquid is placed.

Optionally, the flavor-emanating component includes a flavor thread.

Optionally, the flavor thread is a gel flavor thread, and the gel flavor thread is disposed to extend along the inhalation direction.

Optionally, the flavor-emanating component includes a flavored filler.

Optionally, the isolation portion has a hollow tubular structure, and the isolation passage is disposed in the hollow tubular structure of the isolation portion.

Optionally, the isolation passage comprises a peripheral low-pressure passage structure and a peripheral trench, the peripheral low-pressure passage structure has a cross section in the shape of a multi-pointed star, and the peripheral trench is disposed on an outer circumference of the peripheral low-pressure passage structure.

Optionally, the isolation passage comprises an internal low-pressure passage structure and an internal tunnel, the internal tunnel has a circular cross section, and the internal low-pressure passage structure is disposed on an outer circumference of the internal tunnel.

Another aspect of the present disclosure includes a method of manufacturing a smoke generation product, comprising: connecting a filtration portion and a cooling portion by a first connector, and combining and (composite) shaping them to form a filter base body; and connecting a flavor-producing portion and the filter base body by a second connector, and splicing and shaping them.

Optionally, before connecting a flavor-producing portion and the filter base body by a second connector, and splicing and shaping them, the method of manufacturing further comprises: disposing an isolation portion between the flavor-producing portion and the filter base body.

Optionally, after disposing an isolation portion between the flavor-producing portion and the filter base body, the method of manufacturing further comprises: connecting the flavor-producing portion and the isolation portion by a third connector. The technical solutions of the present disclosure have at least the following beneficial effects:

The present disclosure provides a smoke generation product, comprising: a filter base body, wherein the filter base body comprises a first connector, and a cooling portion and a filtration portion which are sequentially disposed along an inhalation direction, there is a filtration passage inside the filtration portion, there is a cooling passage inside the cooling portion, the filtration portion and the cooling portion are connected by the first connector, and the filtration passage and the cooling passage communicate with each other. It further comprises a second connector. It further comprises a flavor-producing portion, the flavor-producing portion is connected to the filter base body via the second connector, and the flavor-producing portion is configured to release smoke into the cooling passage by being heated. The smoke generation product according to the present disclosure is used for allowing a consumer to inhale smoke, the smoke generation product overcomes the problems of complicated structure and high production cost of the prior smoke generation products, and the smoke generation product has a variety of functions.

The present disclosure provides a method of manufacturing a smoke generation product, the smoke generation product manufactured by the manufacturing method overcomes the problems of complicated structure and high production cost of the prior smoke generation products, and the smoke generation product manufactured by using the manufacturing method has a variety of functions and structures.

BRIEF DESCRIPTION OF DRAWINGS

In order to more clearly illustrate technical solutions of embodiments of the present disclosure, drawings required for use in the embodiments will be introduced briefly below. It is to be understood that the drawings below are merely illustrative of some embodiments of the present disclosure, and therefore should not be considered as limiting its scope. It would be understood by those of ordinary skill in the art that other relevant drawings could also be obtained from these drawings without any inventive effort.

Figure 1:
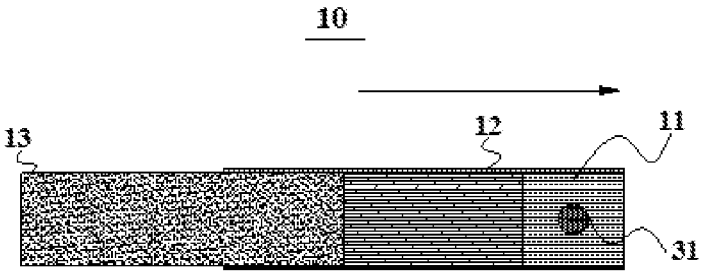
FIG. 1 is a first schematic structural diagram of a smoke generation product according to an embodiment of the present disclosure.

Reference numerals: 10—smoke generation product; 11—filter base body; 12—second connector; 13—flavor-producing portion; 20—cigarette base body; 21—third connector; 22—isolation portion; 31—bead; 40—filtration portion; 41—gel flavor thread; 50—filtration portion; 51—flavored filler; 60—isolation portion; 61—isolation passage; 70—isolation portion; 71—isolation passage; 100—smoke generation product; 110—first connector; 111—filtration portion; 112—cooling portion; 611—peripheral low-pressure passage structure; 612—peripheral trench; 711—internal low-pressure passage structure; 712—internal tunnel.

DETAILED DESCRIPTION OF EMBODIMENTS

In order to make the objects, technical solutions, and advantages of the embodiments of the present disclosure more clear, the technical solutions of the embodiments of the present disclosure will be described below clearly and completely with reference to the drawings of the embodiments of the present disclosure. It is apparent that the embodiments to be described are some, but not all of the embodiments of the present disclosure. Generally, the components of the embodiments of the present disclosure, as described and illustrated in the figures herein, may be arranged and designed in a wide variety of different configurations.

Thus, the following detailed description of the embodiments of the present disclosure, as represented in the figures, is not intended to limit the scope of the present disclosure as claimed, but is merely representative of selected embodiments of the present disclosure. All the other embodiments obtained by those of ordinary skill in the art in light of the embodiments of the present disclosure without inventive efforts would fall within the scope of the present disclosure as claimed.

It should be noted that similar reference numerals and letters refer to similar items in the following figures, and thus once an item is defined in one figure, it may not be further defined or explained in the following figures.

In the description of the present disclosure, it should be noted that orientation or positional relationships indicated by the terms such as "inside" and "down" are the orientation or positional relationships shown based on the figures, or the orientation or positional relationships in which the inventive product is conventionally placed in use, and these terms are intended only to facilitate the description of the present disclosure and simplify the description, but not intended to indicate or imply that the referred devices or elements must be in a particular orientation or constructed or operated in the particular orientation, and therefore should not be construed as limiting the present disclosure. In addition, terms such as "first" and "second" are used for distinguishing the description only, and should not be understood as an indication or implication of relative importance.

In the description of the present disclosure, it should also be noted that terms "disposed" and "connected" should be understood broadly unless otherwise expressly specified or defined. For example, connection may be fixed connection or detachable connection or integral connection, may be mechanical connection, or may be direct coupling or indirect coupling via an intermediate medium or internal communication between two elements. The specific meanings of the above-mentioned terms in the present disclosure could be understood by those of ordinary skill in the art according to specific situations.

The present disclosure will be further explained and described below with reference to the accompanying drawings.

An embodiment of the present disclosure provides a smoke generation product 10, which allows a consumer to inhale (or draw) smoke and is different from the prior smoke generation products.

Figure 2:
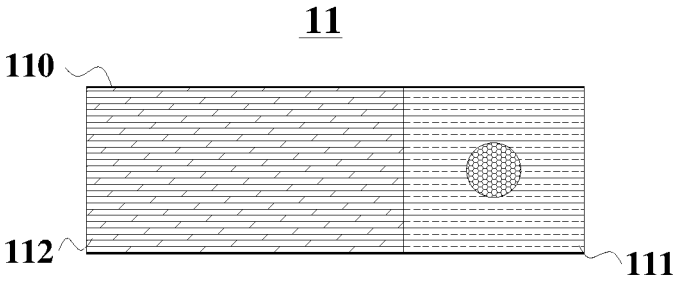
FIG. 2 is a schematic structural diagram of a filter base body in a smoke generation product according to an embodiment of the present disclosure.

With reference to FIG. 1, FIG. 2 shows a specific structure of a smoke generation product 10 according to an embodiment of the present disclosure, and FIG. 2 shows a specific structure of a filter base body 11 according to an embodiment of the present disclosure.

As shown in FIG. 1, the smoke generation product 10 comprises a filter base body 11, a second connector 12, and a flavor-producing portion 13. Here, the flavor-producing portion 13 is connected to the filter base body 11 via the second connector 12, the flavor-producing portion 13 is configured to release smoke by being heated, the flavor-producing portion 13 is a structure for releasing and generating smoke to be inhaled by a consumer, the filter base body 11 is used for being brought into contact with the human body, and the consumer inhales smoke released and generated by the flavor-producing portion 13 through the filter base body 11 to get a feeling of satisfaction and enjoyment. As shown in FIG. 2, the filter base body 11 comprises a first connector 110, and a cooling portion 112 and a filtration portion 111 which are sequentially disposed along an inhalation direction, there is a filtration passage inside the filtration portion 111, there is a cooling passage inside the cooling portion 112, the filtration portion 111 and the cooling portion 112 are connected by the first connector 110, and the filtration passage and the cooling passage communicate with each other, wherein one end of the filtration portion 111 remote from the cooling portion 112 is used for being placed in an oral cavity of a human body for allowing the consumer to inhale smoke.

Here, as shown in FIG. 1, the flavor-producing portion 13 is connected to the filter base body 11 via the second connector 12, and the flavor-producing portion 13 is configured to release smoke into the cooling passage by being heated. Exemplarily, the flavor-producing portion 13 may be composed of a material having a flavoring ingredient, and multiple different flavor types or multiple mixed flavor types or the like may be made according to different aroma preferences of users. This is not specifically limited in the present disclosure.

It should be noted that, firstly, a direction as indicated by an arrow in FIG. 1 is the inhalation direction, and the inhalation direction refers to a direction in which smoke is inhaled when the consumer normally uses the smoke generation product 10.

Secondly, the flavor-producing portion 13 is heated to release smoke which is similar to that generated by the combustion of a traditional combustible smokable cigarette. As shown in FIG. 2, the filtration portion 111 has the function of filtering and adsorbing the smoke generated by heating of the flavor-producing portion 13, the filtration portion 111 is brought into direct contact with the human body to remove larger smoke particles and water-soluble compounds such as aldehydes and phenols while improving the smoking experience, and the cooling portion 112 is located upstream of the filtration portion 111 along the inhalation direction, and has the function of cooling the smoke generated by heating of the flavor-producing portion 13, so that the smoke is at an appropriate temperature when entering the oral cavity of the consumer, and is not too hot to affect the sensory experience.

Thirdly, the filtration portion 111 is made of an air-permeable filtering material having the same function as that of a filter of a conventional combustible smokable cigarette. In the present embodiment, exemplarily, the filtration portion 111 is made of a cellulose acetate filter rod, but the material of the filtration portion 111 is not specifically limited in the present disclosure, and the filtration portion 111 may be made of various filtering materials as long as a condition is satisfied in which it is permeable to air and can filter impurities.

Fourthly, the cooling portion 112 is used for cooling the smoke and improving the mouthfeel. The cooling portion 112 is made of a material having a large specific surface area and having a good heat absorption function. After smoke is released from the flavor-producing portion 13, it is inhaled into the cooling passage, and the smoke conducts heat while passing through the cooling passage and a certain amount of heat is consumed so as to reduce the temperature of the smoke, and the material of the cooling portion 112 does not generate toxic and harmful ingredients and does not generate odor, thus the quality of perception of the inhaled smoke is not affected.

Referring to FIG. 1 and FIG. 2, exemplarily, each of the first connector 110 and the second connector 12 fixedly connects other components by means of wrapping outer circumferential surfaces thereof. Here, the first connector 110 is wrapped around the outer circumferential surfaces of the filtration portion 111 and the cooling portion 112 to achieve the connection of the filtration portion 111 and the cooling portion 112, and they are combined to form an integrated body, i.e., the filter base body 11. A part of the second connector 12 is wrapped around the outer circumferential surfaces of the filtration portion 111 and the cooling portion 112, i.e., wrapped around the outer circumferential surface of the entire filter base body 11, and another part of the second connector 12 is wrapped around the outer circumferential surface of one end of the flavor-producing portion 13 close to the cooling portion 112, that is to say, the second connector 12 is wrapped around a part of the flavor-producing portion 13.

Figure 5:
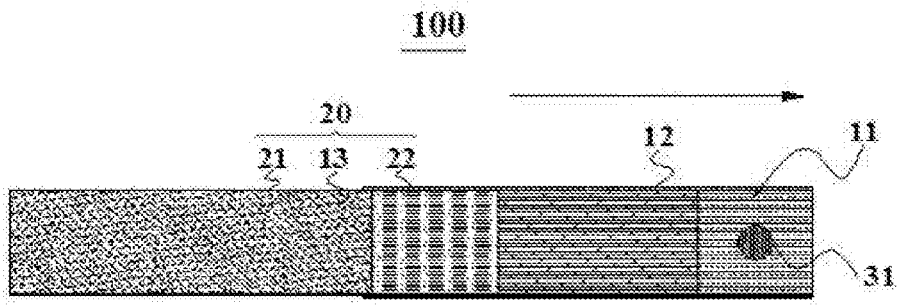
FIG. 5 is a second schematic structural diagram of a smoke generation product according to an embodiment of the present disclosure.

Optionally, as shown in FIG. 5, an isolation portion 22 is further disposed between the flavor-producing portion 13 and the filter base body 11, and an isolation passage is disposed inside the isolation portion 22.

In this way, the isolation portion 22 can isolate the flavor-producing portion 13 from the cooling portion 112, the smoke released by heating of the flavor-producing portion 13 can enter the cooling portion 112 only after firstly passing through the isolation passage of the isolation portion 22, the isolation portion 22 serves the function of precooling the smoke released by heating of the flavor-producing portion 13, and the isolation passage is disposed in order to reduce the inhalation resistance encountered by the user during inhalation, produce a better inhalation experience, and improve the mouthfeel in use.

Optionally, as shown in FIG. 5, the smoke generation product of the present disclosure further comprises a third connector 21, the flavor-producing portion 13 and the isolation portion 22 are connected by the third connector 21, the third connector 21, the isolation portion 22, and the flavor-producing portion 13 constitute a cigarette base body 20, and the cigarette base body 20 is connected to the filter base body 11 via the second connector 12. Similarly, a direction indicated by an arrow in FIG. 5 is a direction in which the smoke generation product of the present disclosure is smoked in use.

Firstly, the flavor-producing portion 13 and the isolation portion 22 are connected by the third connector 21 to form an integrated body, i.e., the cigarette base body 20, and then the integrated cigarette base body 20 is connected to the integrated filter base body 11 via the second connector 12, so that the procedures of fabrication of the smoke generation product 10 of the present disclosure can be further optimized, and the overall yield and the processing and fabrication efficiency of the smoke generation products 10 can be improved.

Specifically, in the present embodiment, the flavor-producing portion 13 includes a flavor-producing material, and exemplarily, the flavor-producing portion 13 may be a flavor-producing material coated with a tobacco extract and a flavorant.

Optionally, the flavor-producing material may include one or more of: grass leaves, whole tobacco leaves, main veins of tobacco leaves, expanded tobacco, and homogenized tobacco.

In addition, the flavor-producing portion 13 may further comprise one or more capsules comprising a tobacco-containing volatile flavoring compound or a tobacco-free volatile flavoring compound, and the above-mentioned compound material is added into the capsule so that it is slowly and uniformly released from the capsule during smoking and use by the user, and mixed to jointly form flavored smoke to be inhaled by the consumer.

Optionally, as shown in FIG. 1, the first connector 110 includes a plug wrap which is wrapped around the outer circumferential surfaces of the filtration portion 111 and the cooling portion 112.

The plug wrap is a material relatively commonly used in the industry and is inexpensive to manufacture. During fabrication using the plug wrap as the first connector 110, the plug wrap is wrapped around the outer circumferential surfaces of the filtration portion 111 and the cooling portion 112 to integrally connect and fix the filtration portion 111 and the cooling portion 112 to form the filter base body 11. The fabrication process is simply and easily carried out.

Optionally, as shown in FIG. 1, the second connector 12 includes a tipping paper, a part of the tipping paper is wrapped around the outer circumferential surfaces of the filtration portion 111 and the cooling portion 112, and another part of the tipping paper is wrapped around the outer circumferential surface of one end of the flavor-producing portion 13 close to the cooling portion 112.

Similarly, the tipping paper is also a material relatively commonly used in the industry and is inexpensive to manufacture. During fabrication using the tipping paper as the second connector 12, the connection is carried out by wrapping a part of the tipping paper around the outer circumferential surfaces of the filtration portion 111 and the cooling portion 112 and wrapping another part of the tipping paper around the outer circumferential surface of one end of the flavor-producing portion 13 close to the cooling portion 112. The fabrication process is simply and easily carried out.

Optionally, as shown in FIG. 2, in order to improve the efficiency of heat conduction, a plurality of cooling passages are disposed inside the cooling portion 112, and the plurality of cooling passages jointly communicate with the filtration passage. With the arrangement of a plurality of cooling passages communicating with the filtration passage, the plurality of cooling passages can jointly dissipate heat to reduce the temperature of the smoke passing therethrough, and the effect of adsorbing harmful particles is also better.

Optionally, a flavor-emanating component is further disposed in the filtration passage of the filtration portion 111.

In this way, when the user is smoking and using the smoke generation product of the present disclosure, during passing of the smoke released by heating of the flavor-producing portion 13 through the filter base body 11, aroma can also be further emanated from the flavor-emanating component disposed in the filtration passage of the filtration portion 111 and mixed with the smoke from the flavor-producing portion to enter the user's mouth. The flavor-emanating component may be provided with various flavor types for selection according to the preferences of users, thereby improving the user experience and mouthfeel in use.

Optionally, as shown in FIG. 1, the flavor-emanating component includes a bead 31 in which a flavor liquid is placed. The bead 31 in which a flavor liquid is placed is disposed in the filtration passage. In use, the bead 31 is broken by increasing the temperature or by other means, and the flavor liquid in the bead 31 volatilizes and is mixed with the smoke from the flavor-producing portion 13 to obtain a different taste to enhance the sensory quality.

Optionally, the flavor-emanating component includes a flavor thread.

Figure 3:
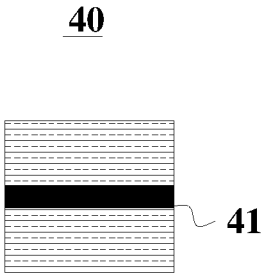
FIG. 3 is a schematic structural diagram of a filtration portion in a smoke generation product according to an embodiment of the present disclosure.

Exemplarily, as shown in FIG. 3, the flavor thread is a gel flavor thread 41, and the gel flavor thread 41 is disposed to extend along the inhalation direction.

As shown in FIG. 3, the gel flavor thread 41 is disposed in the filtration passage to extend along the inhalation direction, and the gel flavor thread 41 may also slowly release and emanate aroma by being heated or by other means. With the gel flavor thread 41, when the smoke generation product 10 is being used, a different taste is obtained and the sensory quality is enhanced while the harmful ingredients of the smoke are reduced.

Figure 4:
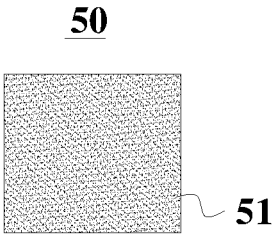
FIG. 4 is another schematic structural diagram of a filtration portion in a smoke generation product according to an embodiment of the present disclosure.

Optionally, as shown in FIG. 4, the flavor-emanating component includes a flavored filler 51.

As shown in FIG. 4, the flavor-emanating component may also include a flavored filler 51 disposed in the filtration portion 50, the flavored filler 51 is uniformly disposed in the filtration passage of the filtration portion 50, and the flavored filler 51 disposed in this manner has a stronger function of slowly releasing and emanating aroma and provides a better experience in use.

Optionally, the isolation portion 22 is a hollow tubular structure, and the isolation passage is disposed in the hollow tubular structure of the isolation portion 22.

In this way, while ensuring the isolation and pre-cooling effects of the isolation portion 22, the isolation portion 22 with a tubular structure has a rigid outer wall, which facilitates the fabrication of the entire smoke generation product.

Figure 6:
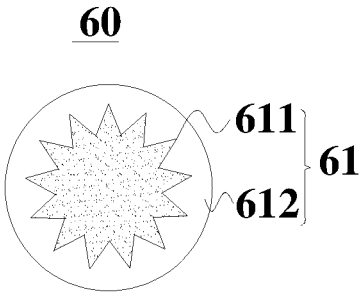
FIG. 6 is a schematic structural diagram of an isolation portion in a smoke generation product according to an embodiment of the present disclosure.

Optionally, as shown in FIG. 6, the isolation passage comprises a peripheral low-pressure passage structure 611 (e.g., a through-trench filter rod) and a peripheral trench 612, the peripheral low-pressure passage structure 611 has a cross section in the shape of a multi-pointed star, and the peripheral trench 612 is disposed on an outer circumference of the peripheral low-pressure passage structure 611.

Figure 7:
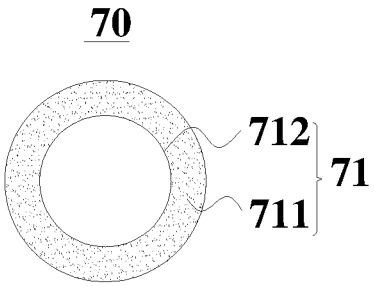
FIG. 7 is another schematic structural diagram of an isolation portion in a smoke generation product according to an embodiment of the present disclosure.

Optionally, as shown in FIG. 7, the isolation passage comprises an internal low-pressure passage structure 711 (e.g., a hollow filter rod) and an internal tunnel 712, the internal tunnel 712 has a circular cross section, and the internal low-pressure passage structure 711 is disposed on an outer circumference of the internal tunnel 712.

The exemplary two structures of the isolation passage are described above, and the present disclosure is not limited to the structures described above as long as the isolation passage can be provided to allow a gas to pass therethrough while ensuring the isolation and pre-cooling effects of the isolation portion 22.

Figure 8:
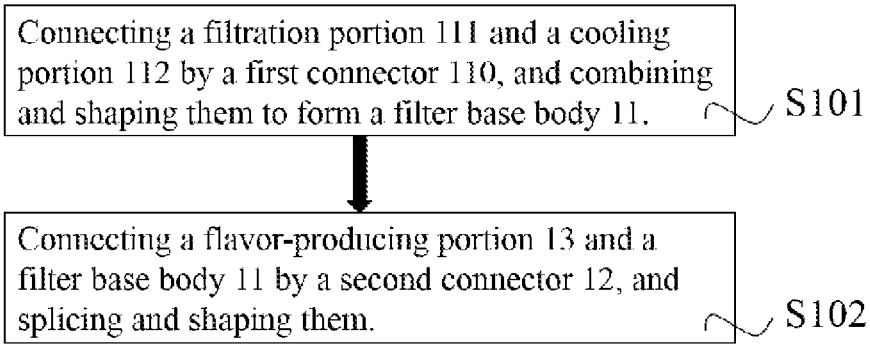
FIG. 8 is a first flowchart of a method of manufacturing a smoke generation product according to an embodiment of the present disclosure.

An embodiment of the present disclosure further provides a method of manufacturing a smoke generation product, as shown in FIG. 8, comprising:

S101 of connecting a filtration portion 111 and a cooling portion 112 by a first connector 110, and combining and shaping them to form a filter base body 11; and S102 of connecting a flavor-producing portion 13 and the filter base body 11 by a second connector 12, and splicing and shaping them.

As shown in FIG. 8, firstly, the filtration portion 111 and the cooling portion 112 are connected by the first connector 110, and are combined and shaped by a filter rod shaping machine to form the filter base body 11, and then the flavor-producing portion 13 and the filter base body 11 are connected by the second connector 12, and are spliced and shaped by a rolling machine to make a finished product of the smoke generation product.

The above-mentioned manufacturing method can be carried out by a filter rod shaping machine or a rolling machine that has been owned by a tobacco manufacturer, and can be used conveniently without repurchasing special equipment.

Figure 9:
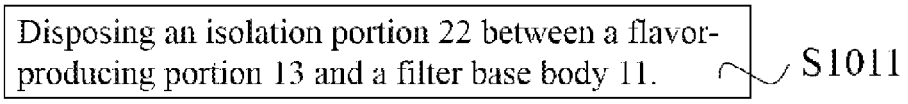
FIG. 9 is a second flowchart of a method of manufacturing a smoke generation product according to an embodiment of the present disclosure.

Optionally, as shown in FIG. 9, before the step S102, the method of manufacturing a smoke generation product of the present disclosure further comprises:

S1011 of disposing an isolation portion 22 between the flavor-producing portion 13 and the filter base body 11.

As shown in FIG. 9, after the filter base body 11 is formed by combining and shaping, an isolation portion 22 is disposed between the flavor-producing portion 13 and the filter base body 11 to isolate the flavor-producing portion 13 from the filter base body 11, so that smoke released by heating of the flavor-producing portion 13 enters the filter base body 11 after being isolated and pre-cooled by the isolation portion 22.

Figure 10:
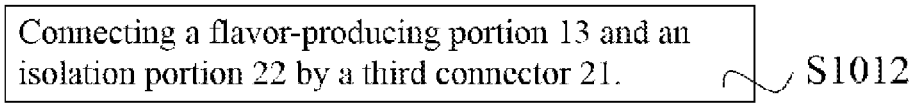
FIG. 10 is a third flowchart of a method of manufacturing a smoke generation product according to an embodiment of the present disclosure.

Optionally, as shown in FIG. 10, after the step S1011, the method of manufacturing a smoke generation product of the present disclosure further comprises:

S1012 of connecting the flavor-producing portion 13 and the isolation portion 22 by a third connector 21.

Firstly, the flavor-producing portion 13 and the isolation portion 22 are connected by the third connector 21 to form an integrated body, i.e., a cigarette base body 20, and then the step S102 is performed in such a manner that the integrated cigarette base body 20 including the position of the flavor-producing portion 13 is connected to the integrated filter base body 11 by the second connector 12, so that the procedures of fabrication of the smoke generation product 10 of the present disclosure can be further optimized, and the overall yield and the processing and fabrication efficiency of the smoke generation products 10 can be improved.

When the smoke generation product of the present disclosure is in use, the mouth of the user is brought into contact with the filtration portion 111 of the filter base body 11, the filter base body 11 is used for inhalation of smoke, and the flavor-producing portion 13 is used for generation of the smoke. When the flavor-producing portion 13 is heated, the flavor-producing portion 13 releases smoke which is similar to that generated by combustion of a traditional combustible smokable cigarette, and the smoke is inhaled through the filter base body 11, so that the user can get a feeling of satisfaction or enjoyment similar to that obtained by smoking a traditional combustible smokable cigarette. Here, the filter base body 11 comprises a first connector 110, and a cooling portion 112 and a filtration portion 111 which are sequentially disposed along an inhalation direction, where the filtration portion 111 has the function of filtering and adsorbing the smoke generated by heating of the flavor-producing portion 13 and is brought into direct contact with the human body to remove larger smoke particles and water-soluble compounds such as aldehydes and phenols while improving the smoking experience, and the cooling portion 112 is located upstream of the filtration portion 111 along the inhalation direction, and has the function of cooling the smoke generated by heating of the flavor-producing portion 13, so that the smoke is at an appropriate temperature when entering the oral cavity of the consumer, and is not too hot to affect the sensory experience.

The above description is merely illustrative of preferred embodiments of the present disclosure and is not intended to limit the present disclosure. It would be understood by those skilled in the art that various modifications and variations can be made to the present disclosure. Any modifications, equivalent alternatives, improvements and so on made within the spirit and principle of the present disclosure are to be included in the scope of protection of the present disclosure.

INDUSTRIAL APPLICABILITY

In summary, the present disclosure provides a smoke generation product and a method of manufacturing the same, which has a simple structure, is fabricated with less process steps, has low production cost, has various functions, and reduces the release of harmful gases when in use.

What is claimed is:

1. A smoke generation product, comprising:

a filter base body, wherein the filter base body comprises a first connector, a cooling portion, and a filtration portion, wherein the cooling portion and the filtration portion are sequentially disposed along an inhalation direction, filtration passages are formed inside the filtration portion, cooling passages are formed inside the cooling portion, the filtration portion and the cooling portion are connected by the first connector, and the filtration passages and the cooling passages communicate with each other;

a second connector; and a flavor-producing portion, wherein the flavor-producing portion is connected to the filter base body via the second connector, and the flavor-producing portion is configured to release smoke into the cooling passages by being heated, wherein an isolation portion is further disposed between the flavor-producing portion and the filter base body to totally isolate the flavor-producing portion from the cooling portion, and isolation passages are disposed inside the isolation portion.

2. The smoke generation product according to claim 1, wherein the smoke generation product further comprises a third connector, and the flavor-producing portion and the isolation portion are connected by the third connector;

the third connector, the isolation portion, and the flavor-producing portion constitute a cigarette base body, and the cigarette base body and the filter base body are connected by the second connector.

3. The smoke generation product according to claim 1, wherein the flavor-producing portion comprises a flavor-producing material.

4. The smoke generation product according to claim 3, wherein the flavor-producing material comprises one or more of grass leaves, whole tobacco leaves, main veins of tobacco leaves, expanded tobacco, and homogenized tobacco.

5. The smoke generation product according to claim 1, wherein the first connector comprises a plug wrap, and the plug wrap is wrapped around outer circumferential surfaces of the filtration portion and the cooling portion.

6. The smoke generation product according to claim 1, wherein the second connector comprises a tipping paper, a first part of the tipping paper is wrapped around outer circumferential surfaces of the filtration portion and the cooling portion, and a second part of the tipping paper is wrapped around an outer circumferential surface of one end of the flavor-producing portion close to the cooling portion.

7. The smoke generation product according to claim 1, wherein a plurality of the cooling passages are formed inside the cooling portion, and the plurality of cooling passages all communicate with the filtration passages.

8. The smoke generation product according to claim 1, wherein a flavor-emanating component is further disposed in the filtration passages of the filtration portion.

9. The smoke generation product according to claim 8, wherein the flavor-emanating component comprises a bead in which a flavor liquid is placed.

10. The smoke generation product according to claim 8, wherein the flavor-emanating component comprises a flavor thread.

11. The smoke generation product according to claim 10, wherein the flavor thread is a gel flavor thread, and the gel flavor thread is disposed to extend along the inhalation direction.

12. The smoke generation product according to claim 8, wherein the flavor-emanating component comprises a flavored filler.

13. The smoke generation product according to claim 1, wherein the isolation portion is a hollow tubular structure, and the isolation passages are disposed in the hollow tubular structure of the isolation portion.

14. The smoke generation product according to claim 13, wherein each of the isolation passages comprises a peripheral low-pressure passage structure and a peripheral trench, the peripheral low-pressure passage structure has a cross section in the shape of a multi-pointed star, and the peripheral trench is disposed on an outer circumference of the peripheral low-pressure passage structure.

15. The smoke generation product according to claim 13, wherein each of the isolation passages comprises an internal low-pressure passage structure and an internal tunnel, the internal tunnel has a circular cross section, and the internal low-pressure passage structure is disposed on an outer circumference of the internal tunnel.

16. A method of manufacturing the smoke generation product of claim 1, comprising:

connecting the filtration portion and the cooling portion by the first connector, and combining and shaping them to form the filter base body; and connecting the flavor-producing portion and the filter base body by the second connector, and splicing and shaping them.

17. The method of manufacturing according to claim 16, wherein before connecting the flavor-producing portion and the filter base body by the second connector and splicing and shaping them, the method of manufacturing further comprises: disposing the isolation portion between the flavor-producing portion and the filter base body.

18. The method of manufacturing according to claim 16, wherein after disposing the isolation portion between the flavor-producing portion and the filter base body, the method further comprises:

connecting the flavor-producing portion and the isolation portion by a third connector.

19. The smoke generation product according to claim 1, wherein the second connector comprises a tipping paper, a first part of the tipping paper is wrapped around outer circumferential surfaces of the filtration portion and the cooling portion, and a second part of the tipping paper is wrapped around an outer circumferential surface of one end of the flavor-producing portion close to the cooling portion.

* * * * *